US005379492A

United States Patent [19]

Glesser

[11] Patent Number: 5,379,492

[45] Date of Patent: Jan. 10, 1995

[54] SPRING CLIP

[76] Inventor: Louis S. Glesser, P.O. Box 800, Golden, Colo. 80402-0800

[21] Appl. No.: 106,995

[22] Filed: Aug. 17, 1993

[51] Int. Cl.[6] ..... A44B 21/00

[52] U.S. Cl. ..... 24/3 L; 24/499

[58] Field of Search ..... 24/3 L, 499, 500, 517, 24/518, 67.3, 67.5, 67.11, 3 J

[56] References Cited

U.S. PATENT DOCUMENTS

| | | | |
|---|---|---|---|
| 1,069,210 | 8/1913 | Ward | 24/67.11 |
| 4,675,898 | 6/1987 | Higgs | 24/499 |
| 4,897,898 | 2/1990 | Chapin | 24/3 L X |

*Primary Examiner*—James R. Brittain

*Attorney, Agent, or Firm*—Roger A. Marrs

[57] ABSTRACT

A spring clip is disclosed herein for use on belt or pocket-held articles such as tools, pens, knives or the like, which includes a mounting block secured to the article that is provided with a pair of spaced-apart and open-ended passageways opening on opposite sides of the block. A clip is employed having folded-over elongated linear sections terminating in opposing spaced-apart lugs adapted to be insertably disposed into the respective passageways so as to act as pivots permitting the linear sections to be raised and lowered to and from the article. A torsional action results when the linear sections of the clip are lifted causing a spring bias urging the linear sections towards the article to provide a yieldable spring clip action.

5 Claims, 1 Drawing Sheet

FIG.1.
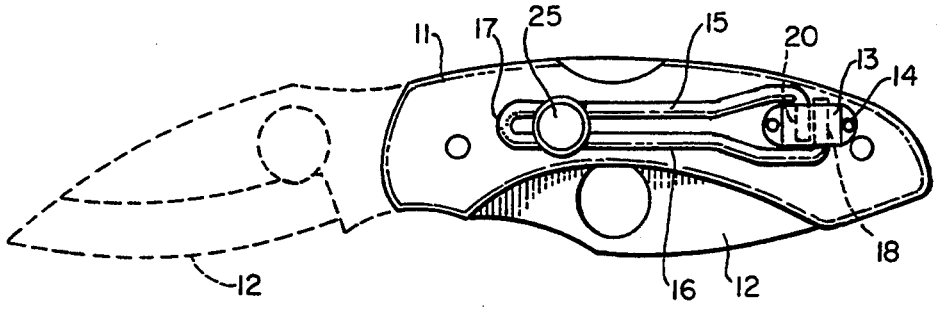
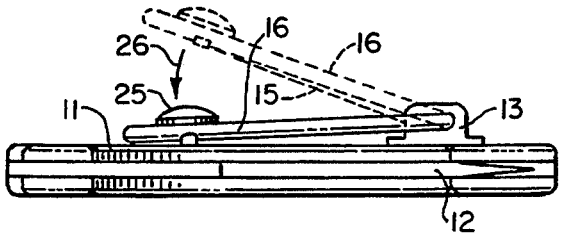
FIG. 2.
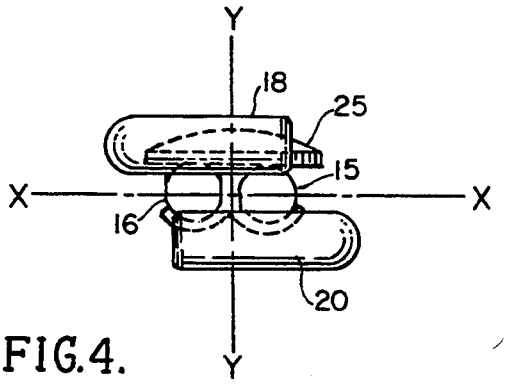
FIG.4.
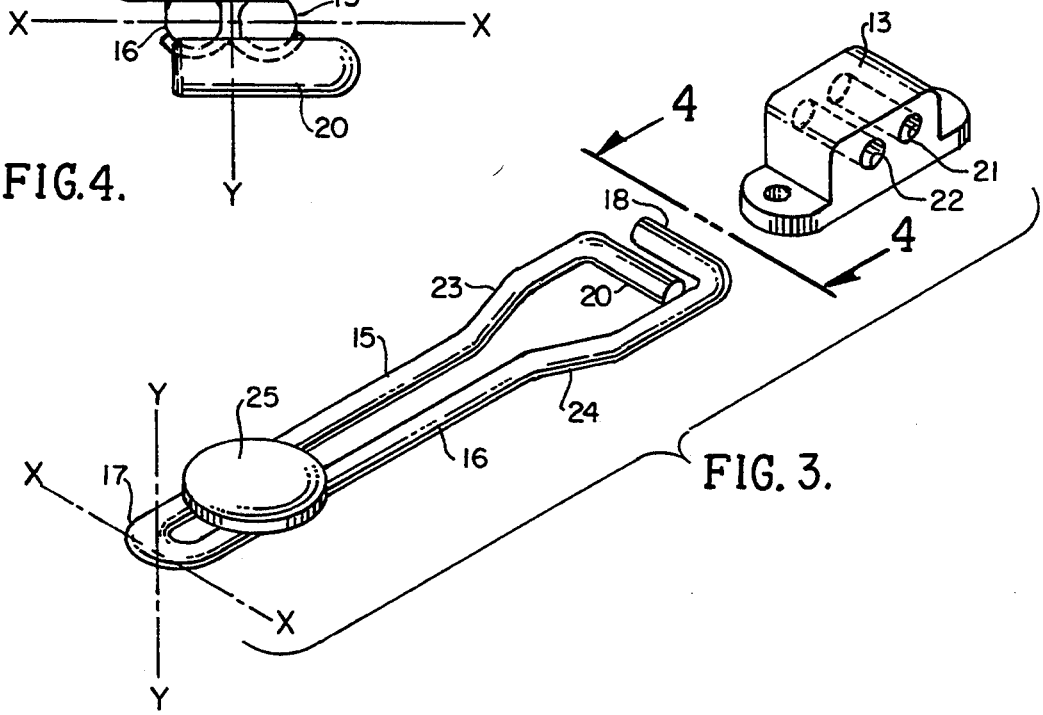
FIG. 3.

SPRING CLIP

BACKGROUND OF THE INVENTION

1. Field of the Invention

The present invention relates to the field of spring clips, and more particularly to a novel clip pivotally carried on an article intended to be suspended from a belt, strap or pocket or the like having a construction which provides a spring bias through a torsional action in order to hold the article in place.

2. Brief Description of the Prior Art

In the past, it has been the conventional practice to employ spring clips on articles intended to be carried in pockets, on belts or the like wherein the spring action is provided by leaf springs, helical springs or in many instances, simply a frictional action to retain the article in place. Such prior uses of springs are costly and require multiple parts which need to be assembled in order to perfect the clip and the clip action. In the case of prior clips employing interference fitting between opposing surfaces of the clip and the article, no spring bias is available for retaining the clip in its supporting action against the belt or pocket material on which the clip is positioned. In other instances, manually operated finger levers or the like are employed to engage the spring action so as to provide a bias resulting in frictional engagement of the clip with the material intended to be engaged by the clip.

Therefore, a long-standing need has existed to provide a simple and convenient means for clipping an article onto a belt, strap or pocket which includes a spring bias action without the necessity of utilizing leaf or helical springs and which does not require assemblage of a multiplicity of components.

SUMMARY OF THE INVENTION

Accordingly, .the above problems and difficulties are obviated by the present invention which provides a novel spring clip for an article which includes a mounting block secured to the article which has a pair of open-ended passageways for rotatably receiving the opposite ends or lug ends of a clip whereby the clip is cantilevered outwardly from the mounting block to terminate in a clip end. The clip includes a pair of linear sections terminating at one end in the clip end while being provided with the lugs at their opposite end and wherein the linear sections are of a differential length so that the respective lugs will insertably fit into the pair of spaced-apart passage-ways. In this manner, the lugs become pivots and as the clip is raised, a torsion action is experienced which resiliently biases the clip towards the article on which the mounting block is carried so that the clip is normally urged towards the article.

The article may take the form of any pocket accessory, such as a knife, pen, tool or the like which is intended to be suspended from a belt, pocket or other supporting structure.

Therefore, it is among the primary objects of the present invention to provide a novel resilient clip for articles which embodies a torsion action to supply a spring bias to a clip member for holding the article in position on a belt, pocket or the like.

Another object of the present invention is to provide a novel resilient or spring-like clip which employs a torsional force when in a first position to spring bias the clip into a support position against the material of the pocket or belt in order to releasably support the article therefrom.

Another object of the present invention is to provide a novel spring clip for holding an article to a belt or pocket, which employs a torsional action rather than employing a helical or leaf spring by which a clip member is yieldably forced into a closing relationship to support the article on a belt or pocket.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a side elevational view of a pocket article such as a knife, which incorporates the spring clip of the present invention;

FIG 2 is a top plan view of the clip shown in FIG. 1 with the clip in its open position illustrated in broken lines and its closed position illustrated in solid lines;

FIG. 3.is an exploded view of the two-part assembly of the clip incorporating the present invention as shown in FIGS. 1 and 2; and FIG. 4 is an elevational view as taken in the direction of arrows 4—4 of FIG. 3.

DESCRIPTION OF THE PREFERRED EMBODIMENT

Referring to FIG. 1, the novel resilient clip of the present invention is illustrated in the general direction of arrow 10 and the clip is illustrated as being carried on the side of a knife 11 which is of the folding blade type so that the knife may be placed in or on the pocket of the user. The blade is shown open in broken lines whereas numeral 12 illustrates the blade in its stored position in solid lines. When in its stored position, the cutting edge of the blade is within the handle and is not exposed. The clip 10 includes a mounting or block 13 that is secured to the side of the knife handle 11 by means of screws 14 or the like. Outwardly projecting from the mounting block 13 in a cantilevered fashion is a clip member comprising a pair of elongated linear sections 15 and 16 which are integral with each other and folded over upon themselves in order to define a clip end 17. The opposite ends of each section 15 and 16 terminate in a lug member, such as lug 18 associated with section 16, and lug 20 associated with section 15. The lugs 18 and 20 are insertably received within open-ended passageways, such as indicated by numerals 21 and 22 in FIG. 3. The passageways are arranged so that their opposite ends are open and exposed on opposite sides of the mounting block 13 and it can be seen that the passageways are in spaced-apart parallel relationship.

Referring further in detail to FIG. 3, it can be seen that the linear sections 15 and 16 are arranged in parallel spaced-apart relationship and that they are integral with one another and are widened at their end opposite to the clip end 17 by means of angled sections 23 and 24 respectively. This construction provides for the thickness of the mounting block 13 which receives the lugs 18 and 20 in the respective passageways. It is of important note to understand that the lugs 18 and 20 reside side by side due to the fact that section 15 is of shorter overall length than the overall length of the section 16. Thus, the lugs 18 and 20 will fit into the respective passageways 21 and 22 by spreading the sections apart and permitting the sections to close by spring action about the clip end 17 so that the lugs will stay within the respective passageways. A button 25 may be employed as a finger-grasping member by the user in order to lift the clip to its raised position as shown in broken lines in FIG. 2. However, it is to be understood that the button 25 is not necessary for the spring action to develop.

As shown more clearly in FIG. 2, when the clip is raised to the position shown in broken lines, a torsional action is developed due to the relationship of the lugs within the passageways due to the difference in length of the respective sections in the clip. Because of the torsional action, a normal spring bias is developed which urges the clip in the direction of arrow 26 towards the knife body 11. It is also the spring action developed by the torsional action which urges the clip against the surface of the knife body in the lowered position, as illustrated in solid lines.

Referring now to FIG. 4, an end view is illustrated of the clip and is illustrated when the clip has not been compressed underneath the mounting clamp or block. This illustration is drawn as axis X—X to show where the clip torsional action is developed. This is the location which provides the clip with its power to clamp. It is noted that this axis is perpendicular to the verticle axis Y—Y. It is also to be noted, as in FIG. 3, that the center line of both passageways or holes through the mounting block are parallel with the surface of the article or object upon which the block is mounted. This arrangement of the passageways contributes to the torsional action when the clip member is raised, as shown in FIG. 2 in broken lines.

Therefore, it can be seen that the novel resilient clip of the present invention provides a clamping action which is developed by the torsion action created when the clip is in its raised position. The power or force of the torsion action urges the clip member in the direction of arrow 26 so that the underside of the clip will press against the edge of a pocket, the thickness of a belt or strap or any other supporting member. The clip member, including the linear sections and lugs, are formed from a single strand or length of material, such as a wire or rod, and the folding over of the rod or wire to form the clip end 17 permits a physical displacement of the sections 15 and 16 when the clip is in its raised position. This displacement is largely caused by the difference in length and therefore position of the lugs 18 and 20 so that the torsional action is readily developed and the sections 15 and 16 are somewhat twisted when elevated to the raised position, as shown in FIG. 2. The invention of the clip may be mounted to a knife, tool, pen or other article and may or may not include the button 25. The mounting or block 13 may be integral with its stationary support or may be attached thereto by suitable means.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A spring clip employing torsional action to achieve retention comprising:

a stationary mounting having a pair of spaced-apart open-ended, side-by-side passageways in parallel relationship opening on opposite sides of said mounting and said passageways having longitudinal axis lying on a common horizontal plane;

an elongated clip member having pivot means insertably carried within said passageways on said mounting;

said pivot means including a pair of lugs laterally overlapping each other on said horizontal plane in spaced relationship and being insertably received from said opposite sides into said pair of passageways respectively;

said mounting includes a portion separating said pair of passageways being of fixed dimension and said spaced-apart clip member lugs being spaced apart substantially equal to said fixed dimension separating said passageways;

said clip member has a first raised position and a second lowered position;

said clip member being twistable about said mounting generating a torsional action providing a yieldable bias urging said clip member into said second lowered position;

said clip member includes an integral member folded over upon itself at its midsection to define a cantilevered clip end at one end of said clip member and said spaced-apart clip member lugs at its opposite end.

2. The invention as defined in claim 1 wherein:

said clip member includes a pair of linear sections joining said clip end with said lugs.

3. The invention as defined in claim 2 including:

a pocket article;

said mounting secured to said pocket article;

said clip member second lowered position operatively engages said clip end against said pocket article in response to retention developed by said torsional action.

4. The invention as defined in claim 3 including:

a finger-grasping button secured to said clip member adjacent said clip end.

5. A spring clip comprising:

a mounting block;

a clip member pivotally carried on said mounting block movable between a raised non-operative position and a lowered operative position;

biasing means coupling said clip member said mounting block developing a torsional action normally biasing said clip member into said lowered operative position;

said biasing means includes said mounting block with opposite sides having a pair of spaced-apart open-ended passageways lying on a common horizontal plane and said clip member having a pair of spaced-apart lugs insertably receivable into said pair of passageways respectively on opposite sides of said mounting block;

said biasing means characterized as being responsive to twisting of said clip member to develop said torsional action.

* * * * *